US006223457B1

(12) United States Patent
Graf

(10) Patent No.: US 6,223,457 B1
(45) Date of Patent: May 1, 2001

(54) SKATE BOOT SHELL FOR SUCH A SKATE BOOT AND HEADPIECE FOR A SKATE BOOT

(75) Inventor: Karl Graf, Kreuzlingen (CH)

(73) Assignee: Graf Skates AG, Kreuzlingen (CH)

( * ) Notice: Subject to any disclaimer, the term of this patent is extended or adjusted under 35 U.S.C. 154(b) by 0 days.

(21) Appl. No.: 09/392,997

(22) Filed: Sep. 9, 1999

(30) Foreign Application Priority Data

Sep. 9, 1998 (CH) ..... 1843/98

(51) Int. Cl.[7] ..... A43B 5/00; A43B 13/22

(52) U.S. Cl. ..... 36/115; 36/72 R; 36/77 R; 280/11.12

(58) Field of Search ..... 36/115, 72 R, 36/77 R, 71, 132, 133; 280/11.12, 811

(56) References Cited

U.S. PATENT DOCUMENTS

| | | | | |
|---|---|---|---|---|
| 1,771,746 | * | 7/1930 | Clifford | 36/77 R |
| 1,806,975 | * | 5/1931 | Johnson | 36/72 R |
| 1,832,866 | * | 11/1931 | Johnson | 36/72 R |
| 2,268,435 | * | 12/1941 | Zucker | 36/72 R |
| 2,891,327 | * | 6/1959 | Leach et al. | 36/72 R |
| 3,175,310 | * | 3/1965 | MacQuaid | 36/72 R |
| 3,806,145 | | 4/1974 | Czeiszperger | 280/11.37 M |
| 4,333,248 | * | 6/1982 | Samuels | 36/72 R |
| 4,342,159 | * | 8/1982 | Edwards | 36/77 R |
| 4,811,501 | * | 3/1989 | Okayasu | 36/77 R |
| 5,839,736 | * | 11/1998 | Chiu et al. | 36/115 |

FOREIGN PATENT DOCUMENTS

| | | |
|---|---|---|
| 9307747 | 9/1993 | (DE) . |
| 0085133 | 8/1983 | (EP) . |
| 2232912 | 1/1975 | (FR) . |
| 511324 | 9/1939 | (GB) . |

* cited by examiner

*Primary Examiner*—M. D. Patterson
(74) *Attorney, Agent, or Firm*—Cooper & Dunham LLP

(57) ABSTRACT

At a skate boot a headpiece is foreseen at the cap area of the boot which headpiece protects the foot of an ice-hockey player, specifically the goaltender against impacts and blows stemming from the puck. This headpiece prevents, furthermore, a lateral sliding off of a leg pad.

3 Claims, 1 Drawing Sheet

SKATE BOOT SHELL FOR SUCH A SKATE BOOT AND HEADPIECE FOR A SKATE BOOT

BACKGROUND OF THE INVENTION

1. Field of the Invention

The present invention relates to a skate boot. The invention also relates to a shell for a skate boot and to a headpiece for a skate boot, as well.

2. Description of the Prior Art

Skate boots, specifically ice-hockey boots are known to be of a conventional design and also of a shell skate boot design having an outer plastic shell and an inner liner boot. Specifically in the case of goaltenders the rubber disks, i.e. pucks impacting with a high speed onto the cap area of the skate boot produce at both mentioned designs strong blows to the feet causing an unpleasant sensation or even giving rise to bodily ailments or injuries.

SUMMARY OF THE INVENTION

Hence, it is a general object of the present invention to provide a skate boot at which mentioned problems do not occur or are reduced.

A further object of the invention is to provide a skate boot with an impact cushioning headpiece on at least a part of its cap.

Due to the fact that a headpiece is located on top of the cap of the skate boot an impact cushioning effect can be arrived at.

The headpiece is preferably formed directly by the shell of a skate boot designed as shell skate boot.

Yet a further object of the invention is to provide a shell for a skate boot of a shell design at which mentioned problems do not occur or are reduced, cushioned.

Still a further object is to provide a shell for a skate boot which has a formed out section which forms a hollow space over the area of the cap which is adapted to receive the inner boot.

Due to the fact that the shell forms a formed out design and, thus, a headpiece above the cap area the desired impact cushioning effect can be arrived at.

Due to the hollow space a temporary deformation of the headpiece due to an impact has no influence on the inner boot or the foot of the bearer of the boot, respectively.

The hollow space is preferably filled by an elastic cushioning material.

A further object of the invention is to provide a solution for a solving of above-mentioned problems at an existing skate boot at a later date.

Yet a further object is to provide an impact cushioning body adapted to be mounted over the cap of the skate boot.

BRIEF DESCRIPTION OF THE DRAWINGS

The present invention will be better understood and objects other than those set forth above will become apparent when consideration is given to the following detailed description thereof. Such description makes reference to the annexed drawings, wherein.

DETAILED DESCRIPTION OF THE PREFERRED EMBODIMENTS

Figure 1:
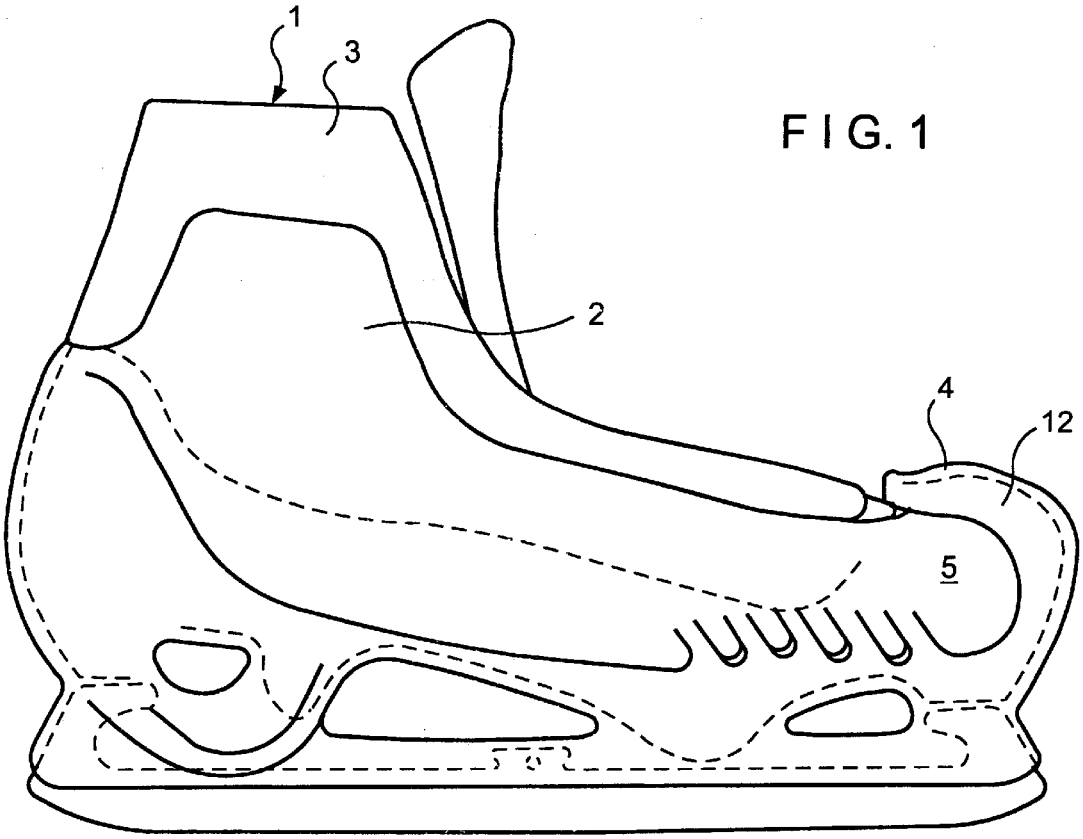
FIG. 1 is a side view of a skate boot of a shell design.
Figure 2:
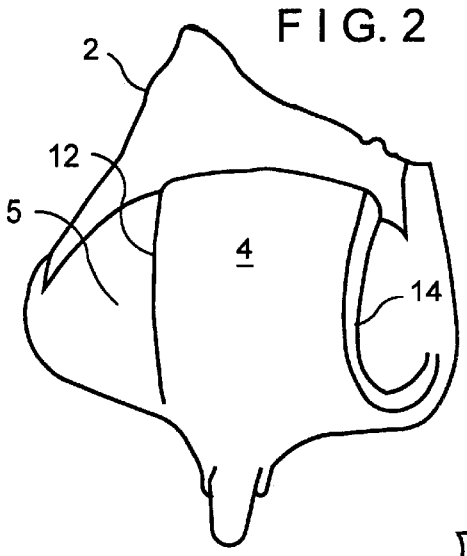
FIG. 2 is a front view of the shell of FIG. 1.
Figure 3:
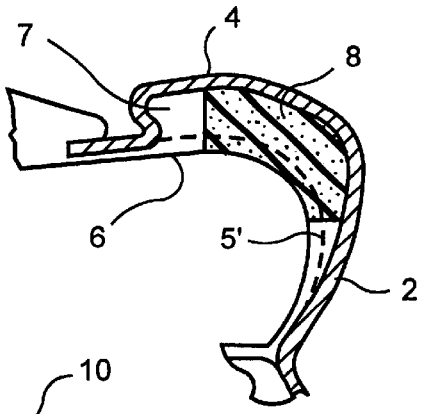
FIG. 3 is a vertical view of a part of the skate boot of FIG. 1.

FIG. 1 illustrates a side view of a skate boot 1 of a shell design. This skate boot includes in a generally known manner a shell 2 made of a plastic material into which a merely schematically shown inner boot 3 or shoe, respectively, is placed. In accordance with the invention the boot 1 comprises a headpiece 4 which is located on top of the cap area of the boot and forms a protection against impacting pucks. The conventional extent of the cap 5 is illustrated by the line 5' (FIG. 3). FIG. 2 shows a front view of the shell 2 without inner boot and blades, whereby the headpiece 4 on the cap area 5 can be seen, too.

FIG. 3 illustrates a vertical section through the center of the cap area of the boot, whereby only a part of the cap area is shown. Specifically shown is the headpiece 4 formed by the shell 2 which in this case includes as such a hollow space 7. At the area of the headpiece 4 the cap area of the boot is open towards this hollow space. The conventional extent of the cap is illustrated by the dash-dotted line 5' and the inner boot by the line 6. The headpiece 4 with the hollow space 7 forms a protection against impacts onto the front area of the skate boot. The hollow space 7 can be filled completely or partly by an elastic cushion. For instance a cushion made of a sponge rubber or another elastic material can be used. The cushion is preferably adapted to the shape of the inner boot and forms a heat insulation and also a cushioning for the impacts caused by the puck.

Figure 4:
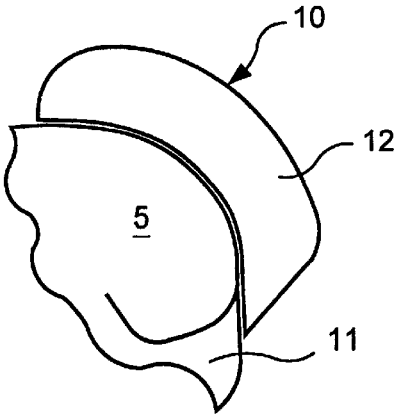
FIG. 4 illustrates a headpiece for a skate boot.

The headpiece can also be designed as a headpiece which is to be placed additionally onto a conventional skate boot 1 at a later date. FIG. 4 illustrates on a rough schematic basis a side view of the cap area 5 of a skate boot which can be of a shell design or of a conventional design. A body 10 is mounted onto the cap area 5 of the skate boot 11, which again forms the headpiece and protects against impacts. The body 10 may consist of a hard material with a hollow space, a chamber, possibly filled by sponge rubber, or also may consist of a softer material, e.g. rubber. The body 10 may be mounted by known mounting means such as e.g. glueing, rivetting or screwing or a combination thereof onto the cap 5 of the skate boot 11.

The described headpieces can, furthermore, form a guiding means for the goaltender's leg pads resting on the cap of the skate boot such as to prevent a lateral slipping away of these generally known leg pads. Such leg pads have a recess for the cap area of the boot. If the headpiece 4 and 10, respectively, such as is preferred is designed with relatively steep lateral flanks 14, they will form respective resting surfaces for the pad and prevent it from laterally gliding off the cap.

While there are shown and described present preferred embodiments of the invention, it is to be distinctly understood that the invention is not limited thereto, but may be otherwise variously embodied and practiced within the scope of the following claims.

What is claimed is:

1. A skate boot comprising a shell made of plastic and having a toe cap, an inner liner fitting within the shell, and a skate blade fixed to the shell, wherein the shell has an inner surface, the liner has an outer surface, and the inner and outer surfaces are in close-fitting relation to each other except near the toe cap, and wherein the toe cap is provided with a headpiece having an inner surface section spaced away by a distance exceeding the shell thickness from the outer surface of the liner, thereby providing a space between the toe cap and the inner surface section of the headpiece.

2. A state boot according to claim 1 further comprising an elastic cushion at least partly filling the space between the toe cap and the inner surface section of the headpiece.

3. A skate boot according to claim 1 wherein the headpiece protrudes from the toe cap and is provided with steep lateral flanks.

* * * * *